US007021235B1

(12) United States Patent
Nikjewicz-Larsen

(10) Patent No.: US 7,021,235 B1
(45) Date of Patent: Apr. 4, 2006

(54) KAYAK AND CANOE COVER

(76) Inventor: Danusia Nikjewicz-Larsen, 23852 Pacific Coast Hwy. #549, Malibu, CA (US) 90265

( * ) Notice: Subject to any disclaimer, the term of this patent is extended or adjusted under 35 U.S.C. 154(b) by 0 days.

(21) Appl. No.: 10/916,818

(22) Filed: Aug. 12, 2004

Related U.S. Application Data

(60) Provisional application No. 60/494,094, filed on Aug. 12, 2003.

(51) Int. Cl.
*B63B 17/00* (2006.01)

(52) U.S. Cl. ..... 114/361; 150/154; 150/166

(58) Field of Classification Search ..... 114/361; 150/154, 166; 206/335, 315.1
See application file for complete search history.

(56) References Cited

U.S. PATENT DOCUMENTS

| | | | | |
|---|---|---|---|---|
| 2,474,031 | A | 6/1949 | Burns | |
| 2,797,697 | A | 7/1957 | Gilmore, Jr. | |
| 3,691,572 | A | 9/1972 | Yannes, Jr. | |
| 4,421,150 | A | 12/1983 | Masters | |
| 4,715,416 | A * | 12/1987 | Horne | 206/315.1 |
| 5,163,550 | A * | 11/1992 | Hawk | 206/315.1 |
| 5,343,824 | A | 9/1994 | Floyd | |
| 5,405,002 | A | 4/1995 | Troia | |
| 5,564,358 | A | 10/1996 | Newton | |
| 6,681,968 | B1 * | 1/2004 | Zwagerman | 224/153 |
| 2003/0164391 | A1 | 9/2003 | Zwagerman | |

* cited by examiner

*Primary Examiner*—Sherman Basinger
(74) *Attorney, Agent, or Firm*—Kelly Lowry & Kelley, LLP

(57) ABSTRACT

The present invention comprises an easy-to-use, adjustable, drop-on cover for water craft that secures to the craft protecting it from UV light, heat, cold, water, wind, yard and road debris, and other environmental elements. The cover is comprised of a top panel, first and second side panels, a draw cord, straps, winch straps, and an attached storage bag for self storage. The panels each possess attached straps and/or winch straps to allow the cover to be adjusted to accommodate crafts of varying sizes. Although, the cover is generally designed to drop over the top of the water craft such that the hull of the craft is exposed, it may also be used in the reverse manner such that the cover is dropped over the hull of the water craft when the craft is stored upside down. The attached storage bag serves a dual purpose of a self storing bag within which the cover can be folded and stored when not in use and a red flag to alert vehicles when the cover is used on a water craft being transported by a vehicle.

30 Claims, 4 Drawing Sheets

KAYAK AND CANOE COVER

CROSS-REFERENCE TO RELATED APPLICATION

This application claims the benefit of U.S. Provisional Application No. 60/494,094, filed Aug. 12, 2003.

STATEMENT RE: FEDERALLY SPONSORED RESEARCH AND DEVELOPMENT

Not Applicable.

BACKGROUND OF THE INVENTION

1. Field of the Invention

The present invention is directed toward an apparatus for protecting a small water craft and, in particular, an easily removable drop on protective cover with self-storing attached bag that may be used while transporting or storing water craft including but not limited to kayaks, canoes, surf skis, rowing skulls or outriggers.

2. Description of the Related Art

The prior art discloses various forms of covers for water craft including hard covers, covers incorporating mechanical devices, over and under covers and full bag covers that require the entire boat to be lifted into the bag. U.S. Pat. No. 5,564,358 discloses a combination boat top cover for use on trailered boats with an underside bow cover secured around the forward periphery of the topside portion and formed in various modes of detachability. U.S. Pat. No. 2,474,031 discloses a boat cover supported above the boat by a spring which is to be raised to an upright supporting position from the exterior of the cover after the cover has been attached to the boat. U.S. Pat. No. 5,405,002 discloses a fully encasing protective bag for transportation of small river running boats including a zipper extending along one side of the body and back-pack like carrying straps. The prior art does not disclose a drop on cover with straps and winch straps capable of adjusting the size of the cover to accommodate different sizes of water craft. Likewise, the prior art does not disclose a drop on cover with an attached bag that securely covers the upper portion of the craft while leaving the hull exposed. Furthermore, the prior art does not disclose a cover with an attached self-storage bag that serves the dual purpose of a storage bag for the cover when not in use and a flag to alert other vehicles of the craft when the cover is used on a craft being transported on top of a vehicle.

One problem with the bag type covers disclosed in the prior art is that they are unsuitable for storing and transporting the water craft across rough surfaces such as sand, dirt, river beds and rocky terrain because the rough surfaces tear and wear away the cover material. Such covers are also impracticable because the entire water craft must be lifted and the cover opened on one end in order to insert the water craft into the cover. Furthermore, since the prior art covers fully encase the water craft they do not permit the water craft to dry while being stored or transported. The other prior art covers discussed above are unsuitable for craft of varying sizes because they are formed with hard materials or comprised of top and bottom portions designed to fit one-size of water craft and are therefore not easily adjusted to fit smaller water craft of varying sizes.

BRIEF SUMMARY OF THE INVENTION

The primary object of the present invention is to provide an easy to use, drop on cover that secures to the water craft so that it can be protected from UV light, heat, cold, water, wind, yard and road debris, and other environmental elements.

Another object of this invention is to provide a drop on cover that may accommodate water craft of a variety of sizes and which is adjustable in width and length to accommodate the size of the water craft allowing for a more customized fit.

Another object of this invention is to provide a drop on cover with an open bottom and a draw cord and straps to allow the cover to be easily secured as well as removed from the water craft.

Another object of this invention is to provide a drop on cover that allows the water craft to "breathe" while covered which is necessary for the protection of the finish or outer coat of some water craft.

Another object of this invention is to provide a drop on cover with an attached bag that doubles as a storage bag for the cover when it is not in use and a flag to alert other vehicles when the cover is used on water craft being transported by a vehicle.

Another object of this invention is to provide a drop on cover with a carrying strap to allow for easy transport of the craft when it is secured within the cover.

The present invention comprises a cover made out of a water resistant material made to withstand UV light, heat, cold, water, wind, yard and road debris, and other environmental elements. The preferred embodiment of the present invention comprises first and second side-panels, an elliptical shaped top-panel, tapered ends, and an open bottom. The bottom edges of the first and second side panels incorporate a draw cord allowing for the sides of the cover to be cinched closed once the cover is placed over a water craft while still leaving the hull exposed. In addition, there are center straps and side winch straps that secure the cover to the craft and adjust the size of the cover to accommodate different size water crafts. The center straps and side winch straps may be secured using various means known in the art, including but not limited to buckles, clips, or hook & loop, such as that sold under the trademark VELCRO®. The invention further comprises a bag attached to one end of the cover such that the cover may be folded up into the bag when not in use. When the cover is in use, the bag serves as a warning flag when the covered water craft is being transported by a vehicle. The bag may be used to store excess draw cord when the cover is secured to a water craft and includes vent holes to permit air to pass through the bag.

DETAILED DESCRIPTION OF THE INVENTION

The instant invention is designed to provide a drop on cover which easily covers various forms of water craft and facilitates storage or transportation of the water craft being covered. The drop on cover further comprises an attached self-storing bag which may be used to store the cover when it is not in use and as a caution flag when the cover is used on water craft being transported by a vehicle. The drop on cover comprises unique utilitarian features as described below.

Figure 1:
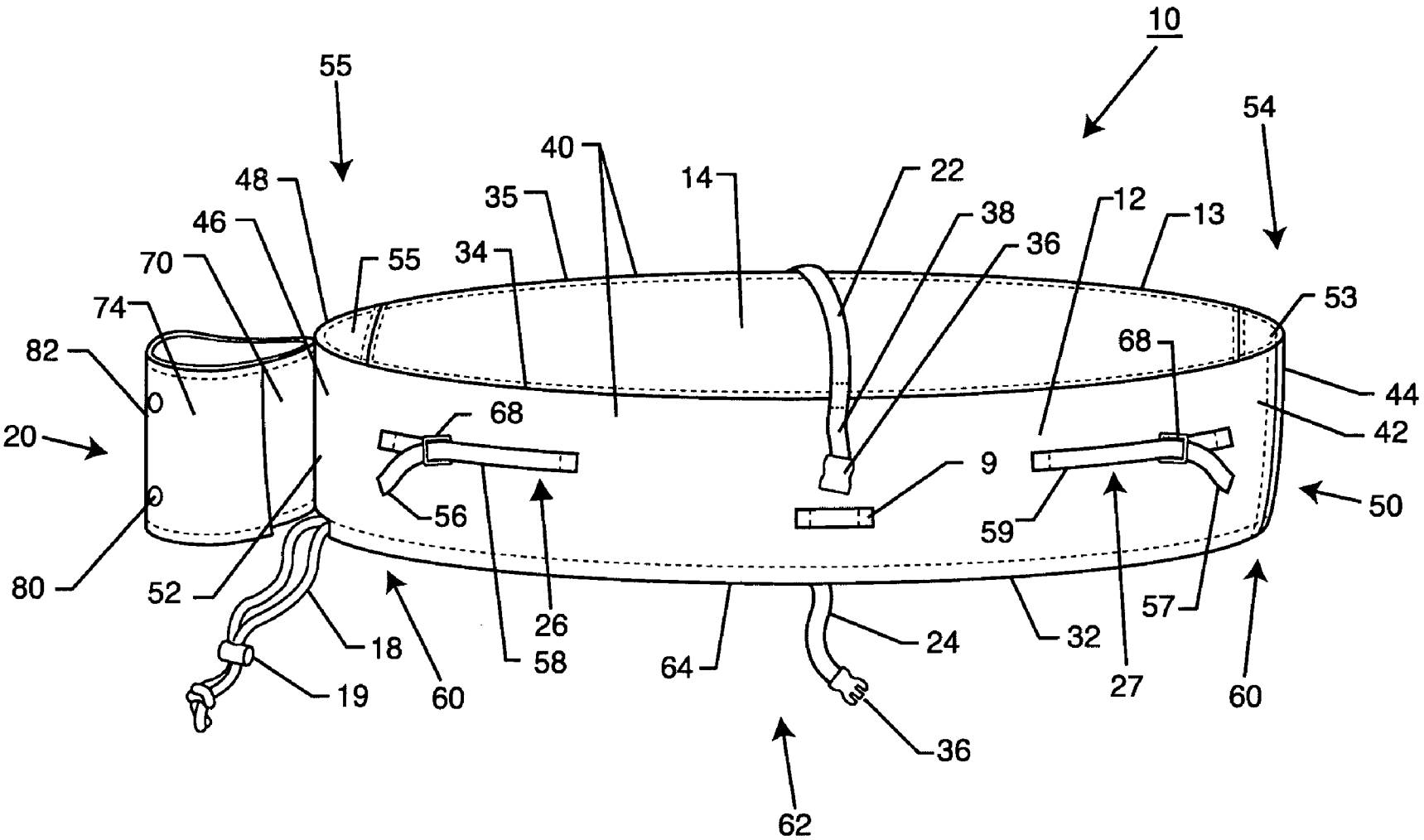
FIG. 1 is a perspective view of the present invention.

Referring to FIG. 1, a protective cover (10) for water craft is shown. The cover (10) comprises a top panel (14) and first and second side-panels (12, 13). The cover (10) has edges corresponding to positions on a water craft, port (35) and starboard (34). The cover (10) also has ends corresponding to positions on a water craft, bow (54), and stern (55). The top panel (14) is wide enough to accommodate water craft of varying widths and long enough to accommodate water craft of varying lengths. The first and second side panels (12, 13) are of equal length extending from the bow (54) to the stern (55) of the top panel (14) and are large enough in width to extend around the sides of water craft of varying depths. The first side panel (12) is attached at its top edge (40) to the starboard (34) edge of the top panel (14). The first side panel (12) has ends corresponding to positions on a water craft, bow (42) and stern (46). The second side panel (13) is attached at its top edge (40) to the port (35) edge of the top panel (14). The second side panel (13) has ends corresponding to positions on a water craft, bow (44) and stern (48).

In the preferred embodiment, the bow end (42) of the first side panel (12) is secured to one edge of a reinforcing bow panel (50). The opposite edge of the reinforcing bow panel (50) is secured to the bow end (44) of the second side panel (13). The bow end (54) of the top panel (14) is then secured to the top edge of the reinforcing bow panel (50). Similarly, the stern end (46) of the first side panel (12) is secured one edge of a reinforcing stern panel (52) and the opposite edge of the reinforcing stern panel (52) is secured to the stern end (48) of the second side panel (13). The stern end (55) of the top panel (14) is then secured to the top edge of the reinforcing stern panel (52). As clearly depicted in FIG. 2, the bow end (54) of the cover (10) may be tapered to allow the cover (10) to fit water craft of varying sizes more closely. The stern (55) of the cover (10) may be similarly tapered.

In an alternative embodiment, the reinforcing bow panel (50) and/or the reinforcing stern panel (52) may be omitted. If the reinforcing bow panel (50) is omitted, then the bow end (42) of the first side panel (12) may be directly attached to the bow end (44) of the second side panel (13). Similarly, if the reinforcing stern panel (52) is omitted, then the stern end (46) of the first side panel (12) may be directly attached to the stern end (48) of the second side panel (13). In either situation, the respective end of the top panel (14) is then attached directly to the first and second side panels (12, 13). In these alternative embodiments, both the bow end (54) and the stern end (55) may be tapered as in the preferred embodiment.

At least one center strap (22) is attached across the top panel (14). In the preferred embodiment, the center strap (22) is secured at the port (35) and starboard (34) edges of the top panel (14) where the top panel (14) meets the first and second side panels (12, 13). The center strap (22) extends beyond the starboard (34) edge of the top panel (14) over the first side panel (12) approximately half the width of the first side panel (12) creating a top strap tail (38). The center strap (22) likewise extends beyond the port (35) edge of the top panel (14) over the second side panel (13) creating a bottom strap tail (24) of sufficient length to pass around the underside of the cover (62) and meet with the top strap tail (38). A suitable form of complimentary, adjustable securing mechanisms (36) such as buckles, clips or hook & loop are affixed to the top strap tail (38) and the bottom strap tail (24) to permit the cover (10) to be tightened around the cover (10) and secured. One or more support loops (9) may be attached to both side panels (12, 13) to maintain the position of bottom strap tail (24) relative to the center strap (22). While FIG. 1 only illustrates one support loop (9) on the first side panel (12), there is a support loop (9) on the second side panel (13) that is not depicted. Such support loop (9) on the second side panel (13) is identical to the support loop (9) that is depicted on the first side panel (12). While FIG. 1 illustrates one center strap (22), one side strap tail (38), and one bottom strap tail (24) more than one of each may be attached at varying distances along the top panel (14), along with a corresponding number of support loops (9) on the first and second side panels (12, 13), to accommodate larger water craft.

FIG. 1 illustrates the first side panel (12) further comprising winch straps (26,27) that are attached to each of the first and second side panels (12, 13) parallel to the bottom edge (64) of the first and second side panels (12, 13). Although, the second side panel (13) is not clearly depicted in FIG. 1, identical copies of the above described winch straps (26, 27) are found in similar fashion on the second side panel (13). Each winch strap (26, 27) is comprised of a free strap (56, 57) and a sliding strap (58, 59). One end of the free strap (56, 57) is secured to the first and second side panels (12, 13). Similarly, one end of the sliding strap (58, 59) is secured to the first and second side panels (12, 13). The free straps (56, 57) and the sliding straps (58, 59) are secured to the first and second side panels (12, 13) in such a manner to permit the gathering of excess material when the cover (10) is used on a water craft of shorter lengths. This gathering of excess material is achieved through the joining by an adjustable, complimentary securing mechanism (68) of the unsecured ends of the free straps (56, 57) and the unsecured ends of the sliding straps (58, 59). The adjustable, complimentary securing mechanism (68) may be buckles, clips, hook & loop or other comparable mechanism known in the art. When the securing mechanisms (68) are adjusted, the secured ends of the free straps (56, 57) and the sliding straps (58, 59) are drawn together to shorten the overall length of the cover (10). The winch straps (26,27) thus allow the cover to be tightened in order to accommodate crafts of varying lengths. While this detailed description describes the use of two winch straps per side panel, the same objects may be achieved through the use of one winch strap or more than two winch straps without departing from the spirit of the invention.

The bottom edge (64) of the first and second side panels (12, 13) further comprises a folded seam (32). The folded seam (32) contains a draw cord (18) along the entire bottom edge (64) of both of the first and second side panels (12, 13). The draw cord (18) may be a contiguous loop of cord around the entire bottom edge (64) of the cover (10). The draw cord in this embodiment includes a slide locking device (19) at the stern end (46, 48) of the cover (10) for tightening the draw cord (18) around the water craft in order to secure the cover (10) to the water craft body. The draw cord (18) may also be a contiguous length of cord where the loose ends meet at the stern end (46, 48) of the cover (10). Similarly, a slide locking device (19) may be used to secure each end of the draw cord (18) to the other. The draw cord (18) may also be two lengths of cord where the loose ends meet at the bow end (42, 44) and the stern end (46, 48) of the cover (10), respectively. In this case, each of the bow end (42, 44) and the stern end (46, 48) has a slide locking device (19) to secure each end of the draw cord (18).

Figure 4:
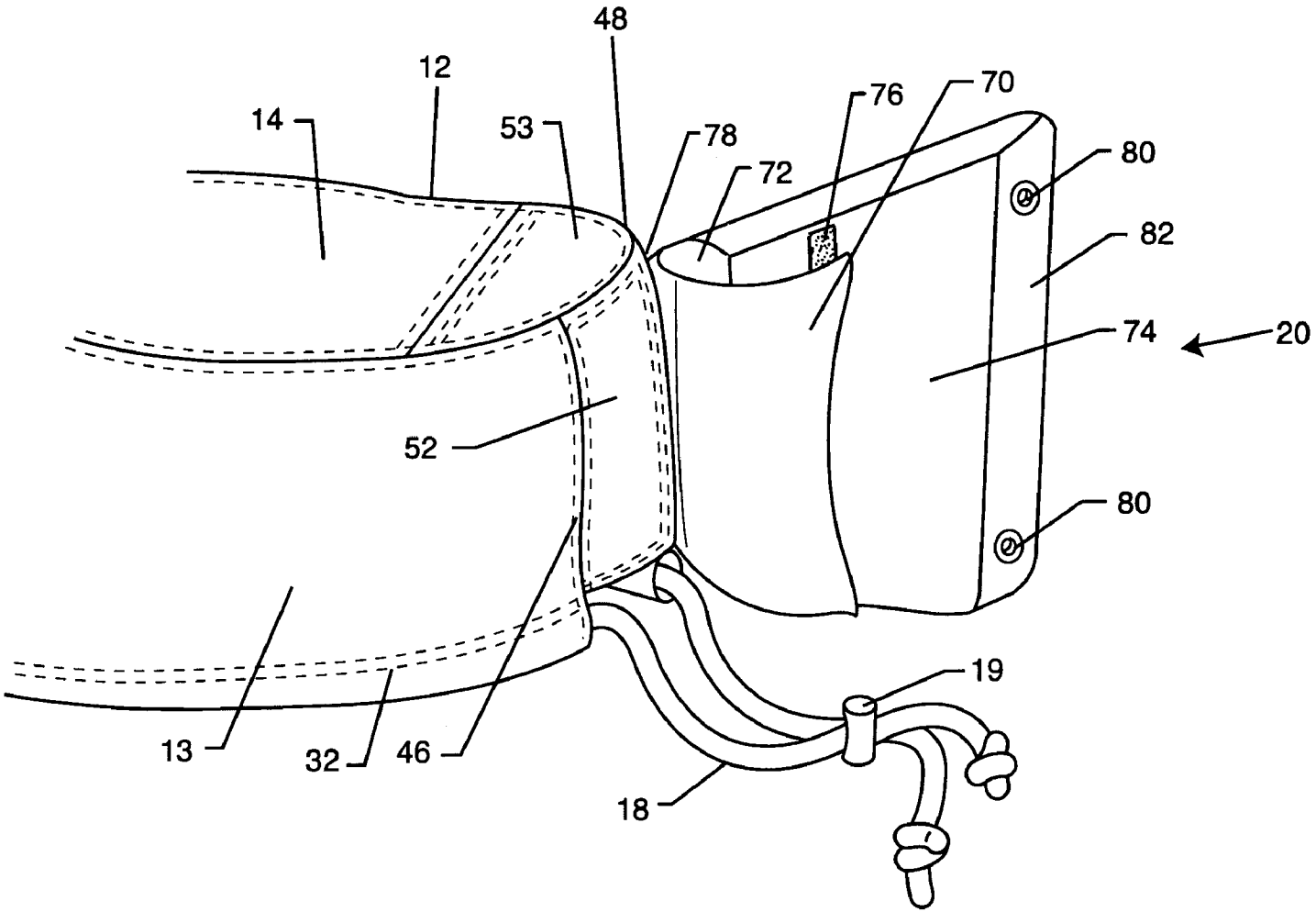
FIG. 4 is an end perspective view of the stern portion of the present invention showing the attached bag.

FIG. 1 further illustrates a storage bag (20) attached to the stern end (55) of the cover (10). The storage bag (20) is illustrated in greater detail in FIG. 4. The storage bag (20) is generally comprised of a bag body (74), an open end (72), a closed end (82), and a flap (70) which covers the open end (72) of the storage bag (20) and folds over the bag body (74). In the preferred embodiment, the flap (70) is secured to the bag body (74) with a hook and loop fastener (76). However, the present invention may also incorporate other forms of fasteners such as buckles, clips, snaps or ties. The flap (70) includes a fold portion (78) that is attached to the reinforced stern panel (52) in the preferred embodiment. The fold portion (78) may be permanently attached to the stern panel, as in stitching, or removably attached, as in a zipper or other removable means. The bag body (74) includes air holes (80) in the closed end (82) to allow for the passage of air, water, and sand from the bag body (74). The storage bag (20) may be of varying color, but is preferably red, which when used in transport, creates a warning flag to indicate excess length possibly extending from the rear of a vehicle transporting a water craft protected by the cover (10). When the cover (10) is not in use, the cover (10) may be folded-up into the storage bag (20) and sealed with the flap (70).

Figure 2:
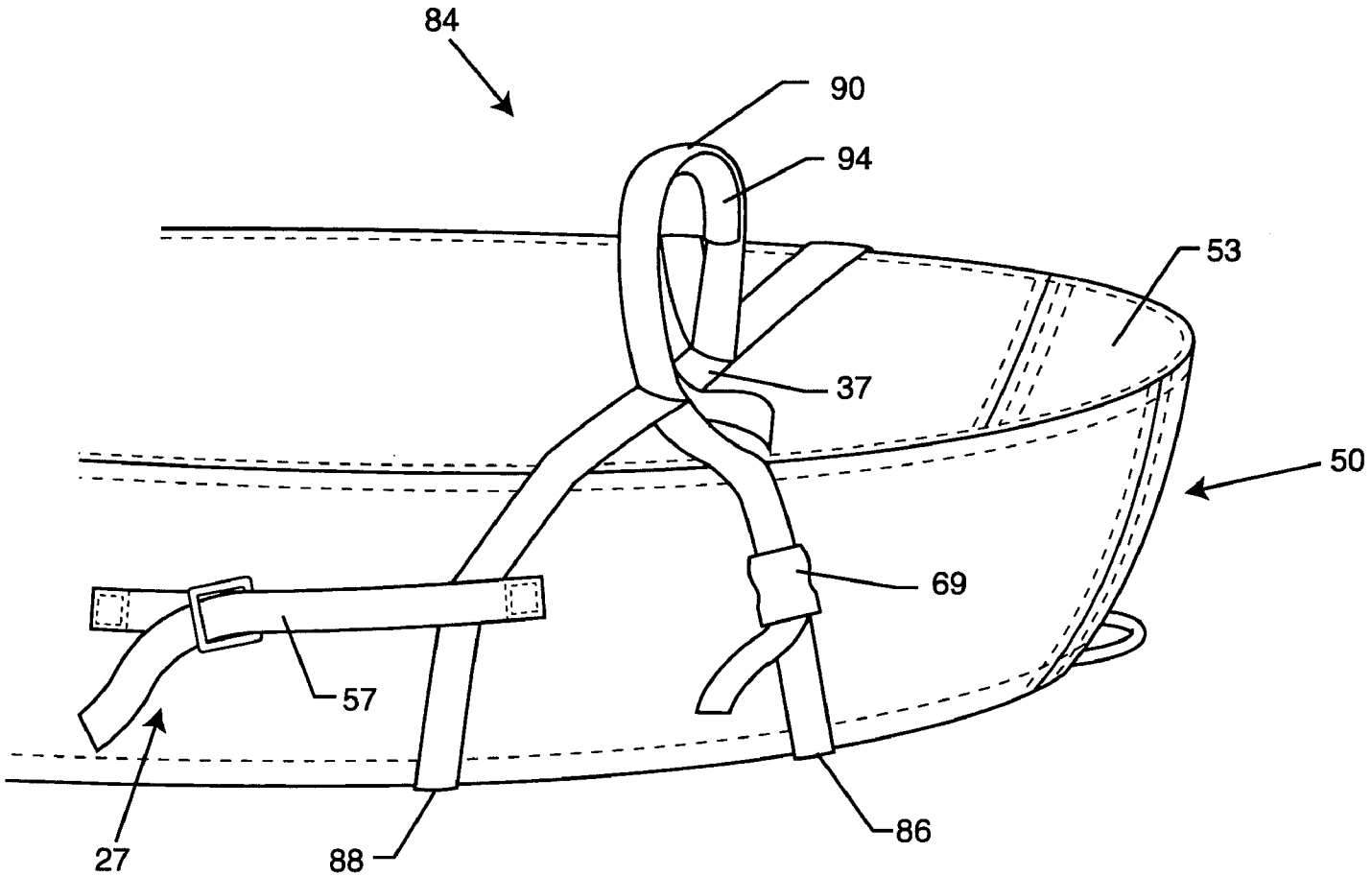
FIG. 2 is an end perspective view of the bow portion of the present invention showing the cover with a tapered end and handle.

Referring to FIG. 2, hold straps (84) may be included to aid in safely transporting the water craft while the cover (10) is in use. The hold straps (84) are comprised of a forward strap (86), back strap (88) and extending handle grip (90). The back strap (88) extends around the bow end (42, 44) of the cover (10) and is secured under the free straps (57) of the winch straps (27) on both the first and second side panels (12, 13). A complimentary securing mechanism (37) such as a buckle, clip, or hook and loop is affixed to each end of the back strap (88) so that each end may be secured to one another at a position above the center of the water craft securing a tapered end. A single strap forms the extending handle grip (90) which is affixed at each end at an equal distance from each side of the complimentary securing mechanism (37) to the back strap (88) such that it extends above the craft cover and may be used as a handle to transport the covered craft. The forward strap (86) extends around the cover (10) between the back strap (88) and the bow end (54) and is attached at each end to the back strap (88) below the attachment points of the extending handle grip (90). The forward strap (86) further includes a suitable form of slide locking device (69) such that the forward strap (86) may be adjusted to a snug fit and further adjusted to provide for better weight balance during transportation. The extending handle grip (90) is further provided with additional padding (94) for a comfortable grip. The cover (10) may be provided with one or more sets of hold straps (84) to facilitate carrying of a water craft protected by the cover (10). Where a hold strap (84) is attached at the stern end (55) of the cover (10) or at another point along the cover (10), the relative positions of the back strap (88) and forward strap (86) may be adjusted accordingly, i.e., over the stern end (55) or the center, to insure secure fit and weight balance.

Figure 3:
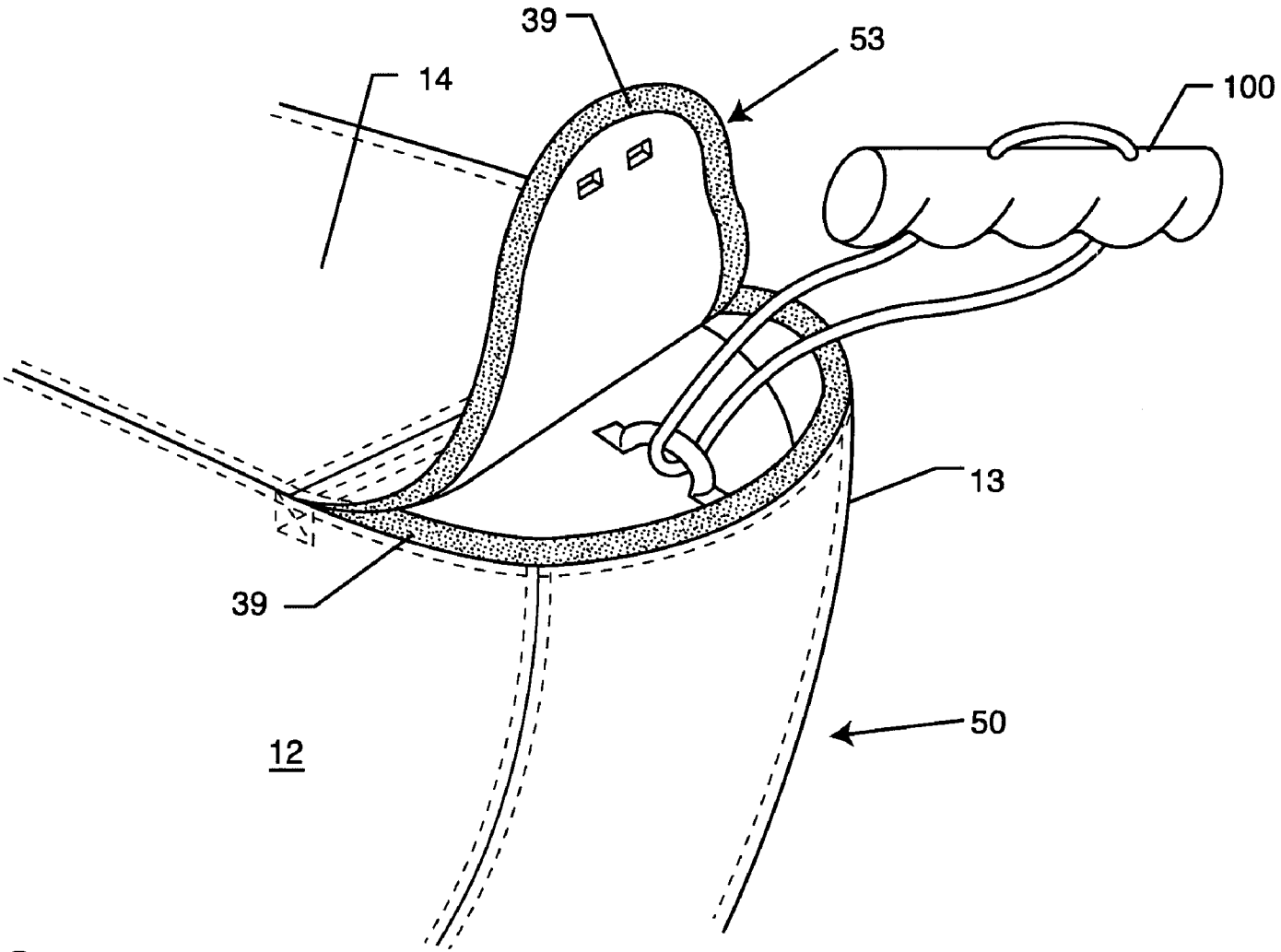
FIG. 3 is an end perspective view of the bow portion of the present invention showing an alternative pull up grip handle.

In an alternative embodiment, FIG. 3 illustrates a variation wherein a reinforced opening flap (53) is provided in the bow end (54) of the top panel (14) where the reinforced bow panel (50), the first and second side panels (12, 13), and the top panel (14) meet. A complimentary attaching mechanism (39) such as hook and loop is affixed around a portion of the reinforced panel (50) and the first and second side panels (12, 13) and the reinforced opening flap (53) which come into contact with one another when the reinforced opening flap (53) is closed. When the cover (10) is in use with a water craft, the reinforced opening flap (53) may be opened and the water craft handle (100) may be inserted through the opening and the covered water craft may be transported by way of the water craft's own handle (100). Similarly, the stern end (55) of the cover (10) may be equipped with a reinforced opening flap (53) which is constructed and operates in the same manner.

The cover (10) and attached storage bag (20) may be formed from any material, either waterproof or treated for water resistance, such as canvas, reinforced mesh material, vinyl or other conventional material, provided that it allows for the primary function of the invention, to protect the water craft from environmental elements such as UV light, heat, cold, water, wind, yard and road debris, and other environmental elements. The draw cord (18), top straps (22, 24, 38, 84, 86, 88), winch straps (26, 27, 56, 57, 58, 59), extending handle grip (90) and other similar components may be formed from any material made to withstand environmental conditions such as nylon, polyester, canvas, or any innovative material that fills the requirements. The complimentary securing mechanisms (36) and slide locking devices (19) may be formed from any durable, non-rusting material, such as plastic. Reinforced stitching may further be provided at the seams.

While the preferred embodiments described above are intended to cover a water craft that is stored in the upright position, it is also contemplated that some water craft are stored upside down. In that instance, the inventive cover may be dropped on the water craft while it is in the upside down position, thereby covering the hull.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A drop cover for water craft comprising:

an elongated, elliptical shaped top panel made from protective material and having port and starboard edges and bow and stern ends, wherein said top panel covers substantially the entire length of the water craft;

a first side panel of elongate shape made from protective material and having top and bottom edges and bow and stern ends, wherein said first side panel covers substantially the entire length of the water craft;

said top edge of said first side panel connected to said starboard edge of said top panel along its entire length;

a second side panel of elongate shape made from protective material and having top and bottom edges and bow and stern ends, wherein said second side panel covers substantially the entire length of the water craft;

said top edge of said second side panel connected to said port edge of said top panel along its entire length;

said bottom edge of said first side panel and said bottom edge of said second side panel each having a folded seam;

said folded seam of said first side panel and said second side panel having a draw cord;

one or more center straps attached to said top panel, said center straps having a top strap tail and a bottom strap tail;

said top strap tails and said bottom strap tails each having complimentary, adjustable securing means for joining said top strap tails and said bottom strap tails together.

2. The drop cover of claim 1 wherein said complimentary, adjustable securing means comprises a buckle.

3. The drop cover of claim 1 wherein said complimentary, adjustable securing means comprises a clip.

4. The drop cover of claim 1 wherein said complimentary, adjustable securing means comprises a hook and loop connector.

5. The drop cover of claim 1 wherein said cover further comprises a reinforcing bow panel attached to said bow end of said first side panel and said bow end of said second side panel, wherein said bow panel substantially covers the bow of the water craft.

6. The drop cover of claim 1 wherein said cover further comprises a reinforcing stern panel attached to said stern end of said first side panel and said stern end of said second side panel, wherein said stern panel substantially covers the stern of the water craft.

7. The drop cover of claim 1 wherein said top panel further comprises a reinforced opening flap in the bow end of the top panel.

8. The drop cover of claim 1 wherein said top panel further comprises a reinforced opening flap in the stern end of the top panel.

9. The drop cover of claim 1 where said cover further comprises a hold strap adjacent to the bow end of the top panel.

10. The drop cover of claim 1 where said cover further comprises a hold strap adjacent to the stern end of the top panel.

11. A drop cover for water craft comprising:

an elongated, elliptical shaped top panel made from protective material and having port and starboard edges and bow and stern ends, wherein said top panel covers substantially the entire length of the water craft;

a first side panel of elongate shape made from protective material and having top and bottom edges and bow and stern ends, wherein said first side panel covers substantially the entire length of the water craft;

said top edge of said first side panel connected to said starboard edge of said top panel along its entire length;

a second side panel of elongate shape made from protective material and having top and bottom edges and bow and stern ends, wherein said second side panel covers substantially the entire length of the water craft;

said top edge of said second side panel connected to said port edge of said top panel along its entire length;

said bottom edge of said first side panel and said bottom edge of said second side panel each having a folded seam;

said folded seam of said first side panel and said second side panel having a draw cord;

one or more winch straps each having a free strap and a sliding strap attached to said first side panel;

said free strap and said sliding strap each having complimentary, adjustable securing means for joining said free strap and said sliding strap together.

12. The drop cover of claim 11 wherein said complimentary, adjustable securing means comprises a buckle.

13. The drop cover of claim 11 wherein said complimentary, adjustable securing means comprises a clip.

14. The drop cover of claim 11 wherein said complimentary, adjustable securing means comprises a hook and loop connector.

15. The drop cover of claim 11 wherein said cover further comprises a reinforcing bow panel attached to said bow end of said first side panel and said bow end of said second side panel, wherein said bow panel substantially covers the bow of the water craft.

16. The drop cover of claim 11 wherein said cover further comprises a reinforcing stern panel attached to said stern end of said first side panel and said stern end of said second side panel, wherein said stern panel substantially covers the stern of the water craft.

17. The drop cover of claim 11 wherein said top panel further comprises a reinforced opening flap in the bow end of the top panel.

18. The drop cover of claim 11 wherein said top panel further comprises a reinforced opening flap in the stern end of the top panel.

19. The drop cover of claim 11 where said cover further comprises a hold strap adjacent to the bow end of the top panel.

20. The drop cover of claim 11 where said cover further comprises a hold strap adjacent to the stern end of the top panel.

21. A drop cover for water craft comprising:

an elongated, elliptical shaped top panel made from protective material and having port and starboard edges and bow and stern ends, wherein said top panel covers substantially the entire length of the water craft;

a first side panel of elongate shape made from protective material and having top and bottom edges and bow and stern ends, wherein said first side panel covers substantially the entire length of the water craft;

said top edge of said first side panel connected to said starboard edge of said top panel along its entire length;

a second side panel of elongate shape made from protective material and having top and bottom edges and bow and stern ends, wherein said second side panel covers substantially the entire length of the water craft;

said top edge of said second side panel connected to said port edge of said top panel along its entire length;

said bottom edge of said first side panel and said bottom edge of said second side panel each having a folded seam;

said folded seam of said first side panel and said second side panel having a draw cord;

a storage bag attached to the drop cover, said storage bag including a bag body, an open end, and a closed end.

22. The drop cover of claim 21 wherein said storage bag is red in color.

23. The drop cover of claim 21 wherein said storage bag includes air holes.

24. The drop cover of claim 21 wherein said storage bag includes a flap to cover said open end.

25. The drop cover of claim 21 wherein said cover further comprises a reinforcing bow panel attached to said bow end of said first side panel and said bow end of said second side panel, wherein said bow panel substantially covers the bow of the water craft.

26. The drop cover of claim 21 wherein said cover further comprises a reinforcing stern panel attached to said stern end of said first side panel and said stern end of said second side panel, wherein said stern panel substantially covers the stern of the water craft.

27. The drop cover of claim 21 wherein said top panel further comprises a reinforced opening flap in the bow end of the top panel.

28. The drop cover of claim 21 wherein said top panel further comprises a reinforced opening flap in the stern end of the top panel.

29. The drop cover of claim 21 where said cover further comprises a hold strap adjacent to the bow end of the top panel.

30. The drop cover of claim 21 where said cover further comprises a hold strap adjacent to the stern end of the top panel.

* * * * *

UNITED STATES PATENT AND TRADEMARK OFFICE

CERTIFICATE OF CORRECTION

PATENT NO. : 7,021,235 B1
APPLICATION NO. : 10/916818
DATED : April 4, 2006
INVENTOR(S) : Danusia Niklewicz-Larsen and Nuuana Robinson It is certified that error appears in the above-identified patent and that said Letters Patent is hereby corrected as shown below:

On the Title page, item (76), the inventor's name should be corrected to read as follows:

-- Danusia Niklewicz-Larsen --

On the Title page, item (76), the second inventor's name and address should be added as follows:

-- Nuuana Robinson, P.O. Box 656, Huntington Beach, CA (US) 92648 --

Signed and Sealed this

Twentieth Day of March, 2007

JON W. DUDAS
*Director of the United States Patent and Trademark Office*